US011015795B2

(12) United States Patent
Kweon

(10) Patent No.: US 11,015,795 B2
(45) Date of Patent: May 25, 2021

(54) LIGHT WEIGHT RADIANT HEAT STRUCTURE OF THERMOELECTRIC POLYMER HEAT SINK AND MANUFACTURING METHOD OF THE SAME

(71) Applicants: HYUNDAI MOTOR COMPANY, Seoul (KR); KIA MOTORS CORPORATION, Seoul (KR)

(72) Inventor: Kyoung Chun Kweon, Seoul (KR)

(73) Assignee: HYUNDAI MOTOR COMPANY & KIA MOTORS CORPORATION, Seoul (KR)

( * ) Notice: Subject to any disclaimer, the term of this patent is extended or adjusted under 35 U.S.C. 154(b) by 78 days.

(21) Appl. No.: 16/210,655

(22) Filed: Dec. 5, 2018

(65) Prior Publication Data

US 2020/0088397 A1 Mar. 19, 2020

(30) Foreign Application Priority Data

Sep. 18, 2018 (KR) ..... 10-2018-0111775

(51) Int. Cl.
*F21V 29/75* (2015.01)
*F21S 45/48* (2018.01)
*F21Y 115/10* (2016.01)

(52) U.S. Cl.
CPC ..... *F21V 29/75* (2015.01); *F21S 45/48* (2018.01); *F21Y 2115/10* (2016.08)

(58) Field of Classification Search
CPC ..... F21V 29/75; F21V 29/87; F21V 29/763; F21V 29/85; F21V 29/76; F21S 45/48; F21Y 2155/10
See application file for complete search history.

(56) References Cited

U.S. PATENT DOCUMENTS

2010/0220469 A1* 9/2010 Ivey ..... F21V 29/507 362/218
2010/0328950 A1* 12/2010 Lai ..... F04D 25/0613 362/249.02
2011/0090686 A1* 4/2011 Pickard ..... F21V 29/74 362/235
2014/0272385 A1* 9/2014 Dickinson ..... F21V 29/75 428/323

FOREIGN PATENT DOCUMENTS

| | | | |
|---|---|---|---|
| EP | 1 821 030 | A1 | 8/2007 |
| JP | 2014-041919 | A | 3/2014 |
| JP | 2014041929 | A | 3/2014 |
| KR | 10-1353907 | B1 | 1/2014 |
| WO | WO 2012/164506 | A1 | 12/2012 |
| WO | WO 2014/172411 | A1 | 10/2014 |

OTHER PUBLICATIONS

Extended European Search Report dated Mar. 29, 2019.

* cited by examiner

*Primary Examiner* — Sharon E Payne
(74) *Attorney, Agent, or Firm* — Brinks Gilson & Lione

(57) ABSTRACT

Provided is a heat-conductive polymer heatsink with a lightweight heat-radiating structure, which may include: a base plate; a plurality of heat-radiating fins, which are formed in a lower part of the base plate to be spaced apart; a substrate, which is connected to an upper part of the base plate; and a light source connected to the substrate; wherein the cross-sectional area of the heat-radiating fin among the plurality of heat-radiating fins formed below the light source is larger than that of the adjacent heat-radiating fins.

9 Claims, 5 Drawing Sheets

LIGHT WEIGHT RADIANT HEAT STRUCTURE OF THERMOELECTRIC POLYMER HEAT SINK AND MANUFACTURING METHOD OF THE SAME

CROSS-REFERENCE TO RELATED APPLICATION

This application claims priority to and the benefit of Korean Patent Application No. 10-2018-0111775, filed on Sep. 18, 2018, the entire contents of which are incorporated herein by reference.

FIELD

The present disclosure relates to a heat-conductive polymer heatsink with a lightweight heat-radiating structure and a manufacturing method of the same.

BACKGROUND

The statements in this section merely provide background information related to the present disclosure and may not constitute prior art.

In a lighting or lamp, a light emitting diode (LED) is conventionally used as a light source that emits light. In head lamps for safe driving, as the brightness of the light gradually increases, the heat generated by the LED becomes greater. The brightness of an LED may deteriorate at a temperature above the operating temperature limit. Accordingly, in the existing industry, a heat-radiating structure made of a metal material for various kinds of lighting fixtures, so-called "heatsink", may be prepared, and the LED light source is attached below the printed circuit board (PCB) substrate mounted on the electric circuit.

The heatsink is a device, which is installed to be in close contact with a heat-generating component such as a PCB substrate or LED substrate so as to radiate heat generated therefrom.

Various kinds of active and passive elements and circuits mounted on the PCB substrate generate a lot of heat when power is applied. Such generated heat has a significant impact on the operation performance of electronic parts. If the heat generated from various kinds of active and passive elements and circuits are not properly released, it may induce the malfunction of the entire components, and thus it may be desirable to lower the temperature of the heat generated. Particularly, highly integrated/high performance components are being developed due to the sophistication of electronic devices, and simultaneously, the technology on "heat radiation" that lowers the temperature is becoming desirable due to the significant increase of the heat temperature.

In a heat-radiating structure where a PCB substrate that connects an LED (i.e., a light source that emits light) with a power source, and a heatsink, that radiates heat, are linked, the LED has a high ratio of energy release into heat, and such a release has an absolute effect on efficiency and lifetime of the heat-radiating structure.

In existing cases, a metal heatsink made of aluminum is used as shown in FIG. 1. Due to high heat conductivity and high specific gravity, aluminum has a drawback in that it has a large weight and a high cost according to processing. Additionally, the aluminum heatsink has high interface heat resistance because a metal core PCB made of aluminum must be attached thereto.

Specifically, in the case of an aluminum heatsink, it has high heat conductivity but it has low heat radiation rate to release heat into the air and thus it may be desirable to increase its surface area. Accordingly, it is desirable that the height of the heat-radiating fin be made long. When the heat-radiating fin is made short, the surface area becomes smaller and thus the heat radiation performance may decrease. However, when the number of the heat radiating fins is increased for improving the heat radiation performance and the height of the heat radiating fins is made long, the use amount of aluminum with high specific gravity is increased thereby significantly increasing the weight of the aluminum heatsink.

The above information disclosed in this Background section is only for enhancement of understanding of the background of the disclosure and therefore it may contain information that does not form the prior art that is already known to a person of ordinary skill in the art.

SUMMARY DISCLOSURE

The present disclosure provides a heat-conductive polymer heatsink with a lightweight heat-radiating structure, in which the degree of heat saturation becomes sufficient thus enabling the improvement of heat-radiation performance and realization of lightweightness, and a manufacturing method of the same.

The heat-conductive polymer heatsink lightweight heat-radiating structure according to one aspect of the present disclosure, includes: a base plate; a plurality of heat-radiating fins, which are formed in a lower part of the base plate to be spaced apart; a substrate, which is connected to an upper part of the base plate; and a light source connected to the substrate; in which the cross-sectional area of the heat-radiating fin among the plurality of heat-radiating fins formed below the light source is larger than that of the adjacent heat-radiating fins.

A seat part which is recessed downward may be provided on the upper part of the base plate, the substrate is seated in the seat part.

The base plate and the plurality of heat-radiating fins may be formed of a plastic material.

The plastic material may include at least one kind selected from poly amide 6 (PA6), modified poly phenylene oxide (MPPO), poly methyl methacrylate (PMMA), poly phenylene sulfide (PPS), poly carbonate (PC), poly butylene terephthalate (PBT), acrylonitrile butadiene styrene (ABS), and polypropylene (PP).

The plastic material may further include at least one kind selected from carbon fiber, graphite, expanded graphite, and graphene.

The thickness from the top surface to the bottom surface of the base plate may be 2 mm to 3.5 mm.

The heat-radiating fin formed below the light source is a first heat-radiating fin, and the adjacent heat-radiating fin is a second heat-radiating fin; and the length of the first heat-radiating fin extended downward from the base plate may be longer than that of the second heat-radiating fin extended downward.

The heat-radiating fin formed downward of the light source is a first heat-radiating fin, and the adjacent heat-radiating fin is a second heat-radiating fin; and the width formed right and left of the first heat-radiating fin may be greater than that formed right and left of the second heat-radiating fin.

The width of the first heat-radiating fin may be 4 mm to 10 mm; and the width of the second heat-radiating fin may be 2 mm to 3 mm.

The distance between the plurality of heat-radiating fins spaced apart may be 6 mm to 10 mm.

The length of the plurality of heat-radiating fins extended downward from the base plate may be 10 mm to 15 mm.

The method for manufacturing a heat-conductive polymer heatsink with a lightweight heat-radiating structure according to an aspect of the present disclosure includes: molding a base plate, to which an insert-injected substrate is connected in an upper part thereof, and a plurality of heat-radiating fins which are formed to be spaced apart in a lower part thereof; and connecting a light source to the substrate; in which, in molding the base plate, the base plate is molded such that the cross-section of the heat-radiating fin among the plurality of heat-radiating fins formed below the light source is formed to be larger than that of the adjacent heat-radiating fin.

The heat-conductive polymer heatsink with a lightweight heat-radiating structure according to one aspect of the present disclosure is disposed in the base plate directly below the light source, in which the cross-sectional area of the heat-radiating fin formed below the light source is larger than that of the adjacent heat-radiating fin, and as a result, the degree of heat saturation may become sufficient thus enabling the improvement of heat-radiation performance, whereas the cross-sectional area of the adjacent heat-radiating fin may be constituted to be relatively small thus enabling the inhibition of an excessive increase of weight.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
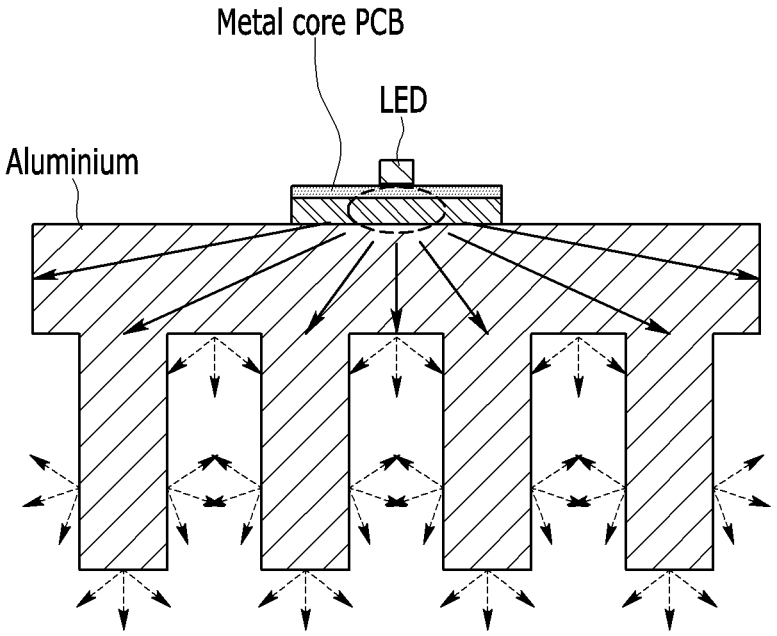
FIG. 1 is a drawing illustrating a conventional aluminum heatsink.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

The terms first, second, third, etc. are used to describe various parts, components, regions, layers and/or sections, but are not limited thereto. These terms are used only to distinguish any part, component, region, layer or section from other parts, components, regions, layers or sections. Accordingly, the first portion, component, region, layer or section described below may be referred to as a second portion, component, region, layer or section within a range that does not depart from the scope of the present disclosure.

The terminology used herein is not intended to limit the present disclosure. As used in the specification, the meaning of "comprising" embodies certain features, regions, integers, steps, operations, elements and/or components, and does not exclude the presence or addition of other features, regions, integers, steps, operations, elements and/or components.

If a part is referred to as being "above" or "on" another part, it may be directly on top of another part or may be accompanied by another part therebetween. In contrast, if a part mentions that it is "directly above" another part, no other part is interposed therebetween.

Unless otherwise defined, all terms including technical terms and scientific terms used herein have the same meaning as commonly understood by those skilled in the art to which the present disclosure belongs. Commonly used predefined terms are further construed to have meanings consistent with the relevant technical literature and the present disclosure and are not to be construed as ideal or very formal meanings unless defined otherwise.

Hereinafter, one aspect of the present disclosure will be described in detail so that those skilled in the art can readily carry out the present disclosure. As those skilled in the art would realize, the described forms may be modified in various different ways, all without departing from the spirit or scope of the present disclosure.

Heat-Conductive Polymer Heatsink with a Lightweight Heat-Radiating Structure

Figure 2:
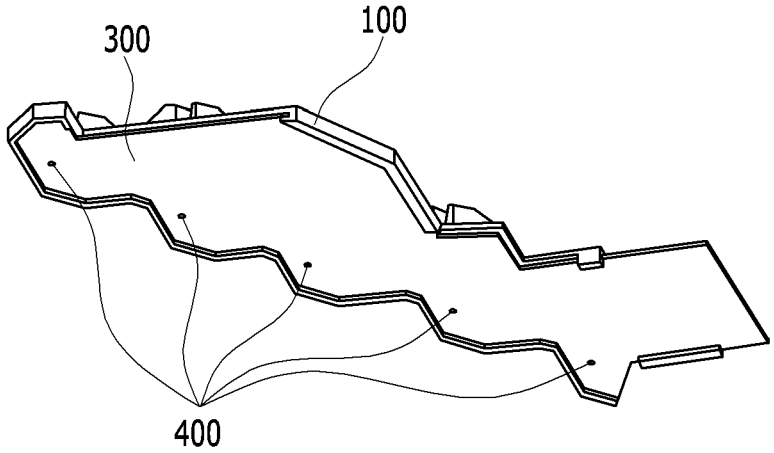
FIG. 2 is a drawing illustrating a heat-conductive polymer heatsink with a lightweight heat-radiating structure.
Figure 2:
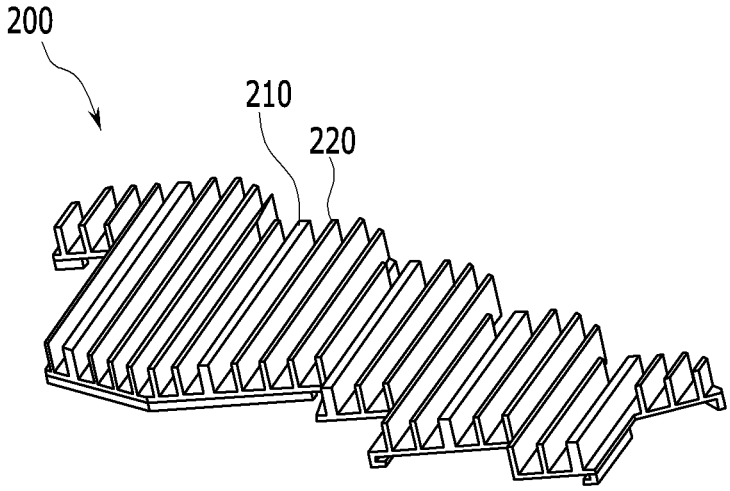
Figure 3:
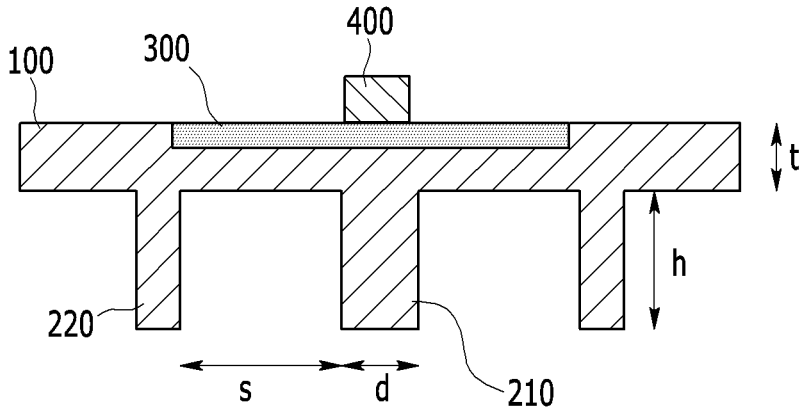
FIG. 3 is a drawing illustrating a cross-sectional side view of a heat-conductive polymer heatsink with a lightweight heat-radiating structure.

The heat-conductive polymer heatsink with a lightweight heat-radiating structure according to one aspect of the present disclosure, as shown in FIGS. 2 and 3, includes: a base plate 100; a plurality of heat-radiating fins 200, which are formed in a lower part of the base plate 100 to be spaced apart; a substrate 300, which is connected to an upper part of the base plate 100; and a light source 400 connected to the substrate 300; in which the cross-sectional area of the heat-radiating fin 200 among the plurality of heat-radiating fins formed below the light source 400 is larger than that of the adjacent heat-radiating fins 200.

In the base plate 100, the substrate 300 is connected to an upper part of the base plate 100, and the plurality of heat-radiating fins 200 are formed in a lower part of the base plate 100. Specifically, the thickness (t) from the top surface to the bottom surface of the base plate 100 may be 2 mm to 3.5 mm.

The heat-radiating fins 200 are formed in plurality in a lower part of the base plate 100 to be spaced apart. Specifically, the heat-radiating fins 200 may be extended downward from the lower surface of the base plate 100. The heat generated from the light source 400 can be emitted to the outside.

Specifically, the distance between the plurality of heat-radiating fins 200 spaced apart (i.e., the gap (s) between the plurality of heat-radiating fins) may be 6 mm to 10 mm. When the gap (s) between the radiating fins 200 is less than 6 mm, thermal entrapment may occur between the radiating fins 200. Meanwhile, when the gap (s) between the radiating fins 200 exceeds 10 mm, the surface area may deteriorate.

Additionally, the length (h) of the plurality of heat-radiating fins 200 extended downward from the base plate 100 may be 10 mm to 15 mm. When the extended length (h) of the radiating fins 200 is less than 10 mm, thermal entrapment may occur between the radiating fins 200. Meanwhile, when the extended length (h) of the radiating fins 200 exceeds 15 mm, the effect of improving the heat radiation performance may not be significant, and only the weight may be increased.

The base plate 100 and the plurality of radiating fins 200 are integrally formed and may be formed of a plastic material. Specifically, the base plate 100 and the plurality of radiating fins 200 may be formed of a material containing at least one kind selected from poly amide 6 (PA6), modified poly phenylene oxide (MPPO), poly methyl methacrylate (PMMA), poly phenylene sulfide (PPS), poly carbonate (PC), poly butylene terephthalate (PBT), acrylonitrile butadiene styrene (ABS), and polypropylene (PP). More specifically, the base plate 100 and the plurality of radiating fins 200 may be formed as a complex material by further containing at least one kind selected from carbon fiber, graphite, expanded graphite, and graphene. The plastic material may have 10 W/mk or greater of heat conductivity.

As such, a plastic material with low specific gravity and high radiation rate may be used. Accordingly, it is possible to reduce the weight and volume of the base plate 100 and the plurality of radiating fins 200.

The substrate 300 is connected to an upper part of the base plate 100 and may be formed of a metal core PCB. The substrate 300 may be formed of A1050 or A5052, which is an alloy of aluminum A1050 or magnesium. Specifically, a seat part, which is recessed downward, may be provided in an upper part of the base plate 100, and the substrate 300 may be seated on the seat part.

Particularly, during the process of manufacturing the heat-conductive polymer heatsink with a lightweight heat-radiating structure, the substrate 300 undergoes an insert injection and is thereby connected to the base plate 100. Accordingly, additional adhesive or mediator for heat transfer such as interface heat transfer material (TIM) is not necessary between the substrate 300 and the base plate 100. Accordingly, the interface resistance can be reduced and heat transfer efficiency can be improved. The details will be described later. The light source 400 is connected to the substrate 300 and may be comprised of an LED light source 400. The LED light source 400 is basically used as a 1 chip package, and a package containing 2 chip, 3 chip, 4 chip, 5 chip, etc. may be used.

The plurality of radiating fins 200 formed in a lower part of the base plate 100 are classified into the radiating fins 200, which are formed in a lower part of the light source 400, and the adjacent radiating fins 200, based on the side cross-section. Since the lower part of the light source 400 in the base plate 100 is an intensive heating part due to the light source 400, the degree of heat saturation must be sufficient to improve the heat radiation performance. Accordingly, the radiating fins 200 are disposed in the base plate directly below the light source 400, in which the cross-sectional area of the heat-radiating fins 200 formed below the light source 400 is larger than that of the adjacent heat-radiating fins 200.

The cross-section of the radiating fin 200 may be calculated by multiplying the expanded length (h) of the radiating fin 200 by the width (d) of the radiating fin 200.

As such, the heat radiation performance can be improved as the degree of heat saturation becomes sufficient, and the adjacent heat radiating fins may be constituted such that their cross-sections are relatively small so as to inhibit the excessive increase of the weight. The number of the radiating fins 200 formed below the light source 400 may vary depending on the number of the LED light sources 400 connected to the substrate 300.

The heat-conductive polymer heatsink with a lightweight heat-radiating structure according to an aspect of the present disclosure may be applied to the low beam module which constitutes the vehicle head lamps and may be also applicable to the high beam and daytime running lamp (DRL).

Specifically, when the radiating fin 200 formed below the light source 400 is the first radiating fin 210 and the adjacent radiating fin 200 is the second radiating fin 220, the length of the first radiating fin 210 expanded downward from the base plate 100 may be formed to be longer than that of the second radiating fin 220 expanded downward from the base plate 100 so as to improve the degree of heat saturation of the first radiating fin 210. In particular, the first radiating fin 210 and the second radiating fin 220 may have a different length while they have the same width.

Alternatively, the width of the first radiating fin 210 formed right and left thereof may be formed to be thicker than that of the second radiating fin 220 so as to improve the degree of heat saturation of the second radiating fin 220. In particular, the first radiating fin 210 and the second radiating fin 220 may have a different width while they have the same length, and the width of the first radiating fin 210 may be 4 mm to 10 mm and the width of the second radiating fin 220 may be 2 mm to 3 mm.

When the width of the first radiating fin 210 is less than 4 mm, the effect of improving the degree of heat saturation may not be sufficient. Meanwhile, when the width of the first radiating fin 210 exceeds 10 mm, the effect of improving heat radiation performance may not be significant and only the weight may be increased.

Meanwhile, when the width of the second radiating fin 220 is less than 2 mm, there may occur a phenomenon of deterioration of the injection property. In contrast, when the width of the second radiating fin 220 exceeds 3 mm, likewise, the effect of improving heat radiation performance may not be significant and only the weight may be increased.

Manufacturing Method of Heat-Conductive Polymer Heatsink with a Lightweight Heat-Radiating Structure The method for manufacturing a heat-conductive polymer heatsink with a lightweight heat-radiating structure according to an aspect of the present disclosure includes: molding a base plate, to which an insert-injected substrate is connected in an upper part thereof, and a plurality of heat-radiating fins which are formed to be spaced apart in a lower part thereof; and connecting a light source to the substrate; in which, in molding the base plate, the base plate is molded such that the cross-section of the heat-radiating fin among the plurality of heat-radiating fins formed below the light source is formed to be larger than that of the adjacent heat-radiating fin.

First, in molding a base plate, a substrate is disposed in a mold and an insert injection molding is performed such that the substrate is connected to an upper part thereof, whereas a base plate on which a plurality of radiating fins are formed is molded is formed in a lower part thereof. However, in particular, the base plate is molded such that the cross-section of the heat-radiating fin among the plurality of heat-radiating fins formed below the light source is formed to be larger than that of the adjacent heat-radiating fin.

As the substrate is insert-injected and connected to a base plate as described above, additional adhesive or mediator for heat transfer, such as interface heat transfer material (TIM), is not necessary between the substrate and the base plate. Accordingly, the interface resistance may be reduced, and heat transfer efficiency may be improved. In addition, the description of the base plate, radiating fins, and substrate will be replaced with the above description in order to avoid redundant explanation. Then, a light source is electrically connected to the substrate.

Hereinafter, the specific examples of the present disclosure are described. However, the following examples are only illustrative of the present disclosure and are not intended to limit the scope of the present disclosure.

EXAMPLES

1 Manufacture of Heat-Conductive Polymer Heatsink with a Lightweight Heat-Radiating Structure A heat-conductive polymer heatsink with a lightweight heat-radiating structure was manufactured in Examples and Comparative Examples according to the present disclosure under the conditions disclosed in Table 1.

Specifically, the plastic material that constitutes the base plate and the heat radiating fins had heat conductivity of 15 W/mK. As the material for the substrate, the aluminum alloy of Al1050 was used, and as the light source, the LUW CEUP model (Osram GmbH) was used. The ambient temperature was set at 105° C. reflecting the environment in the head lamps, the gravity direction was set at −Y axis gravity-9.8 $m/s^2$, in a state without an external housing or case, and the heat source used was five 1 chip at the level of LED 1.533 W.

TABLE 1

| CASE | Material | Mode of Connection | Length (mm) | Gap (mm) | Width (mm | Thickness (mm) | Remarks |
|---|---|---|---|---|---|---|---|
| 1 | PA6/MPPO + carbon filler | Insert injection | 10 | 2 | 1 | 2.5 | Comparative Example |
| 2 | PA6/MPPO + carbon filler | Insert injection | 10 | 2 | 2 | 2.5 | Comparative Example |
| 3 | PA6/MPPO + carbon filler | Insert injection | 10 | 2 | 4 | 2.5 | Comparative Example |
| 4 | PA6/MPPO + carbon filler | Insert injection | 10 | 4 | 2 | 2.5 | Comparative Example |
| 5 | PA6/MPPO + carbon filler | Insert injection | 10 | 6 | 2 | 2.5 | Comparative Example |
| 6 | PA6/MPPO + carbon filler | Insert injection | 30 | 2 | 2 | 2.5 | Comparative Example |
| 7 | PA6/MPPO + carbon filler | Insert injection | 30 | 4 | 2 | 2.5 | Comparative Example |
| 8 | PA6/MPPO + carbon filler | Insert injection | 30 | 4 | 4 | 2.5 | Comparative Example |
| 9 | PA6/MPPO + carbon filler | Insert injection | 30 | 6 | 2 | 2.5 | Comparative Example |
| 10 | PA6/MPPO + carbon filler | Insert injection | 30 | 6 | 2 | 3.5 | Comparative Example |
| 11 | PA6/MPPO + carbon filler | Insert injection | 30 | 6 | 4 | 3.5 | Comparative Example |
| 12 | ADC12 (aluminum) | Attachment of adhesive | 10 | 6 | 4/2 | 2.0 | Example |
| 13 | PA6/MPPO + carbon filler | Insert injection | 10 | 6 | 4/2 | 2.0 | Example |
| 14 | PA6/MPPO + carbon filler | Insert injection | 10 | 6 | 4/2 | 2.0 | Example |
| 15 | PA6/MPPO + carbon filler | Insert injection | 10 | 6 | 11/2 | 2.0 | Example |
| 16 | PA6/MPPO + carbon filler | Insert injection | 10 | 6 | 9/3 | 2.0 | Example |
| 17 | PA6/MPPO + carbon filler | Insert injection | 10 | 6 | 9/4 | 2.0 | Example |
| 8 | PA6/MPPO + carbon filler | Insert injection | 10 | | 0/3 | .0 | Example |

In Table 1, the connection method means the method of connecting a substrate with a base plate, and the length, gap, and width means the length, gap, and width of each heat radiating fin. With respect to the width, when the first and second radiating fins are included, the width of the first heat radiating fin and the width of the second heat radiating fin were described sequentially from the left. The thickness means the thickness of a base plate.

2 Evaluation of Heat-Conductive Polymer Heatsink with a Lightweight Heat-Radiating Structure To examine the heat radiation effect in Examples and Comparative Examples, the junction temperatures of light sources were measured, and the weight of the heat-conductive polymer heatsink with a lightweight heat-radiating structure was measured.

The results are shown in Table 2 below.

TABLE 2

| CASE | LED Junction Temperature (° C.) | Weight (g) | Remarks |
|---|---|---|---|
| 1 | 131.04 | 205.90 | Comparative Example |
| 2 | 131.05 | 252.05 | Comparative Example |
| 3 | 130.71 | 303.12 | Comparative Example |
| 4 | 130.89 | 199.52 | Comparative Example |
| 5 | 131.08 | 175.66 | Comparative Example |
| 6 | 129.45 | 557.83 | Comparative Example |
| 7 | 129.31 | 422.74 | Comparative Example |
| 8 | 129.22 | 551.75 | Comparative Example |
| 9 | 129.15 | 357.39 | Comparative Example |
| 10 | 128.92 | 392.56 | Comparative Example |
| 11 | 128.51 | 482.03 | Comparative Example |
| 12 | 130.44 | 301.40 | Example |
| 13 | 130.21 | 157.87 | Example |
| 14 | 130.06 | 277.62 | Example |
| 15 | 130.05 | 302.73 | Example |
| 16 | 130.08 | 300.94 | Example |

TABLE 2-continued

| CASE | LED Junction Temperature (° C.) | Weight (g) | Remarks |
|---|---|---|---|
| 17 | 130.08 | 352.11 | Example |
| 18 | 129.93 | 324.26 | Example |

In Table 2, the LED junction temperature means the average temperature of five chips, and the weight means the weight of the heat-conductive polymer heatsink with a lightweight heat-radiating structure.

Figure 4:
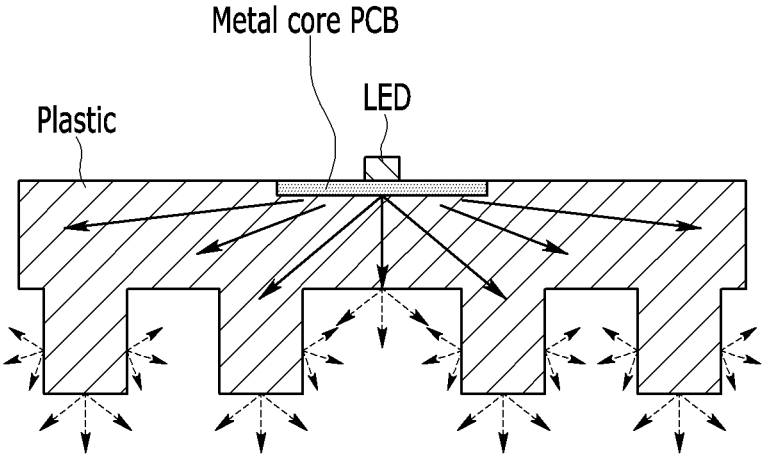
FIG. 4 is a drawing illustrating a heatsink according to Comparative Examples.
Figure 5:
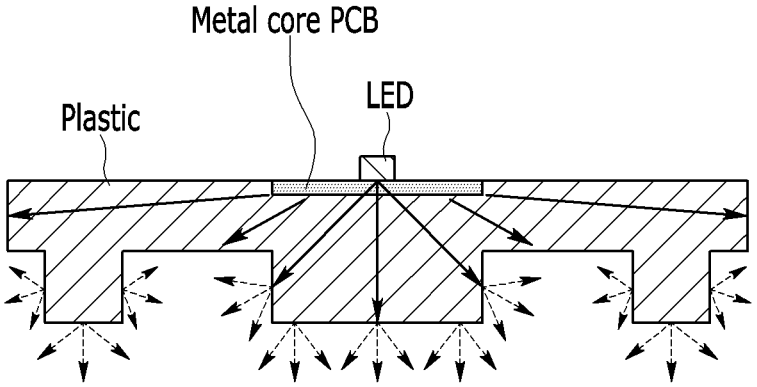
FIG. 5 is a drawing illustrating a heatsink according to Examples of the present disclosure.

In Table 2, referring to FIG. 4 and FIG. 5, the LED junction temperatures (° C.) of CASES 1 to 5, which are Comparative Examples, were measured and they were shown to be higher than those of CASES 12 to 18, which are Examples. This may mean that the heat radiation effect is insufficient compared to Examples, and this may be caused by the members of heat radiating fins with sufficient degree of heat saturation in a lower part of the substrate.

The LED junction temperatures (° C.) of CASES 6 to 11, which are Comparative Examples, were measured and they were shown to be 130° C. or lower thus having an excellent heat radiation effect, but had the weight of 357 g or greater thus having a greater weight compared to those of Examples. This is due to the excessive increase of the length of heat radiation fins.

Even in Examples, the base plate and heat radiating fins were formed of a plastic material, and the substrate was connected to the base plate by an insert injection molding, and the first heat radiating fin with a greater cross-section area was formed in a lower part of the substrate, and CASE 13 where the heat radiating fin was formed with an improved length, gap, and width, showed a heat radiation effect identical to those of other Examples, and simultaneously, showed a weight of less than 158 g thus being lightest.

The present disclosure is not limited and may be manufactured in various other forms, and those skilled in the art will be able to understand that the present disclosure may be embodied in other specific forms without departing from the spirit thereof. Therefore, it should be understood that the above-described examples are to be considered in all respects only as illustrative and not restrictive.

DESCRIPTION OF SYMBOLS

| | |
|---|---|
| 100: base plate | 200: heat-radiating fin |
| 210: first heat-radiating fin | 220: second heat-radiating fin |
| 300: substrate | 400: light source |

What is claimed is:

1. A heat-conductive polymer heatsink with a lightweight heat-radiating structure, comprising:

a base plate;

a plurality of heat-radiating fins, which are formed in a lower part of the base plate to be spaced apart;

a substrate, which is connected to an upper part of the base plate; and a light source connected to the substrate;

wherein a cross-sectional area of the heat-radiating fin among the plurality of heat-radiating fins formed below the light source is larger than that of adjacent heat-radiating fins, wherein a seat part that is recessed downward is provided on the upper part of the base plate, and the substrate is seated in the seat part;

wherein the heat-radiating fin formed below the light source is a first heat-radiating fin, and an adjacent heat-radiating fin is a second heat-radiating fin;

wherein a length of the first heat-radiating fin extended downward from the base plate is longer than that of the second heat-radiating fin extended downward; and wherein a width formed to a right and to a left of the first heat-radiating fin is greater than that formed right and left of the second heat-radiating fin.

2. The heat-conductive polymer heatsink with a lightweight heat-radiating structure of claim 1, wherein:

the base plate and the plurality of heat-radiating fins are formed of a plastic material.

3. The heat-conductive polymer heatsink with a lightweight heat-radiating structure of claim 2, wherein:

the plastic material comprises at least one kind selected from poly amide 6 (PA6), modified poly phenylene oxide (MPPO), poly methyl methacrylate (PMMA), poly phenylene sulfide (PPS), poly carbonate (PC), poly butylene terephthalate (PBT), acrylonitrile butadiene styrene (ABS), and polypropylene (PP).

4. The heat-conductive polymer heatsink with a lightweight heat-radiating structure of claim 3, wherein:

the plastic material further comprises at least one kind selected from carbon fiber, graphite, expanded graphite, and graphene.

5. The heat-conductive polymer heatsink with a lightweight heat-radiating structure of claim 4, wherein:

a thickness from a top surface to a bottom surface of the base plate is 2 mm to 3.5 mm.

6. The heat-conductive polymer heatsink with a lightweight heat-radiating structure of claim 1, wherein:

the width of the first heat-radiating fin is 4 mm to 10 mm; and the width of the second heat-radiating fin is 2 mm to 3 mm.

7. The heat-conductive polymer heatsink with a lightweight heat-radiating structure of claim 1, wherein:

a distance between the plurality of heat-radiating fins spaced apart is 6 mm to 10 mm.

8. The heat-conductive polymer heatsink with a lightweight heat-radiating structure of claim 1, wherein:

the length of the plurality of heat-radiating fins extended downward from the base plate is 10 mm to 15 mm.

9. A method for manufacturing a heat-conductive polymer heatsink with a lightweight heat-radiating structure, comprising:

molding a base plate, to which an insert-injected substrate is connected in an upper part thereof, and a plurality of heat-radiating fins which are formed to be spaced apart in a lower part thereof; and connecting a light source to the substrate;

wherein, in molding the base plate, the base plate is molded such that a cross-section of the heat-radiating fin among the plurality of heat-radiating fins formed below the light source is formed to be larger than that of the adjacent heat-radiating fin, wherein a seat part that is recessed downward is provided on the upper part of the base plate, and the substrate is seated in the seat part;

wherein the heat-radiating fin formed below the light source is a first heat-radiating fin, and an adjacent heat-radiating fin is a second heat-radiating fin;

wherein a length of the first heat-radiating fin extended downward from the base plate is longer than that of the second heat-radiating fin extended downward; and wherein a width formed to a right and to a left of the first heat-radiating fin is greater than that formed right and left of the second heat-radiating fin.

* * * * *